US007701126B2

(12) United States Patent
Hu et al.

(10) Patent No.: US 7,701,126 B2
(45) Date of Patent: Apr. 20, 2010

(54) FIELD EMISSION DISPLAY INCORPORATING GATE ELECTRODES SUPPORTED BY A BARRIER ARRAY LAMINATE

(75) Inventors: Zhaofu Hu, Beijing (CN); Pijin Chen, Beijing (CN); Liang Liu, Beijing (CN); Shoushan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 1442 days.

(21) Appl. No.: 10/817,721

(22) Filed: Apr. 2, 2004

(65) Prior Publication Data

US 2004/0195957 A1 Oct. 7, 2004

(30) Foreign Application Priority Data

Apr. 3, 2003 (CN) ..... 03 1 14139

(51) Int. Cl.

| | |
|---|---|
| ***H01J 1/304*** | (2006.01) |
| ***H01J 1/48*** | (2006.01) |
| ***H01J 1/52*** | (2006.01) |
| ***H01J 9/18*** | (2006.01) |
| ***H01J 9/24*** | (2006.01) |

(52) U.S. Cl. ..... 313/495; 313/496; 313/497; 445/24; 445/25

(58) Field of Classification Search ..... 313/292–304, 313/306–311, 336, 351, 495–497, 402
See application file for complete search history.

(56) References Cited

U.S. PATENT DOCUMENTS

| | | | | |
|---|---|---|---|---|
| 5,606,225 | A * | 2/1997 | Levine et al. | 315/169.3 |
| 5,654,607 | A * | 8/1997 | Yamaguchi et al. | 313/495 |
| 5,656,887 | A * | 8/1997 | Voshell et al. | 313/496 |
| 5,777,432 | A * | 7/1998 | Xie | 313/495 |
| 5,831,378 | A * | 11/1998 | Rolfson et al. | 313/336 |
| 6,087,766 | A * | 7/2000 | Janning | 313/336 |
| 6,121,721 | A * | 9/2000 | Alwan | 313/309 |
| 6,366,009 | B1 | 4/2002 | Smith | |
| 6,515,415 | B1 | 2/2003 | Han et al. | |
| 6,525,462 | B1 | 2/2003 | Kim | |
| 6,541,906 | B2 | 4/2003 | Lee et al. | |

(Continued)

FOREIGN PATENT DOCUMENTS

JP 2004164892 A * 6/2004

(Continued)

*Primary Examiner*—Mariceli Santiago
(74) *Attorney, Agent, or Firm*—Wei Te Chung

(57) ABSTRACT

A field emission display includes: a substrate (11); cathode electrodes (21) formed on the substrate; a plurality of emitters formed on the cathode electrodes; a barrier array (41) defining a plurality of openings (42) therethrough according to a pixel pattern, the barrier array comprising a shadow mask with an insulative layer (43) formed thereon, the barrier array being fixed to the substrate; gate electrodes (51) formed on the barrier array; and a phosphor screen (70) spaced from the substrate. This field emission display employs the known technology for making a shadow mask in the field of CRTs. In addition, the thickness and the material of the insulative layer can be determined according to the insulative performance required for the field emission display. In summary, the present invention provides a field emission display having a high precision, and low production cost barrier array.

17 Claims, 2 Drawing Sheets

U.S. PATENT DOCUMENTS

| | | | | |
|---|---|---|---|---|
| 6,650,061 | B1 * | 11/2003 | Urayama et al. | 315/169.3 |
| 6,806,637 | B2 * | 10/2004 | Uemura et al. | 313/495 |
| 7,336,025 | B2 * | 2/2008 | Hu et al. | 313/292 |
| 2002/0033667 | A1 * | 3/2002 | Yamashita | 313/553 |

FOREIGN PATENT DOCUMENTS

| | | | |
|---|---|---|---|
| JP | 2004281284 | A * | 10/2004 |

* cited by examiner

FIELD EMISSION DISPLAY INCORPORATING GATE ELECTRODES SUPPORTED BY A BARRIER ARRAY LAMINATE

BACKGROUND OF THE INVENTION

1. Field of the Invention

The present invention relates to a field emission display. Specifically, the present invention relates to a field emission display having an improved barrier array.

2. Description of Prior Art

Field emission displays are well known in the art and are widely used since they have a small volume, low power consumption, high contrast ratio, large viewing angle and are suitable for mass production. In an FED device, electrons are emitted from tips formed on cathode electrodes by applying a voltage to the tips. The electrons impinge on a phosphor screen formed on a back of a transparent plate and thereby produce an image.

A conventional field emission display employs metal microtips as emitters. However, it is difficult to precisely fabricate extremely small metal microtips for the field emission source. This difficulty greatly limits miniaturization of a conventional field emission display. In addition, metal microtips themselves are prone to wear out after a long period of use.

Carbon nanotubes produced by arc discharge between graphite rods were first discovered and reported in an article by Sumio Iijima entitled "Helical Microtubules of Graphitic Carbon" (Nature, Vol. 354, Nov. 7, 1991, pp. 56-58). Carbon nanotubes have excellent mechanical properties, high electrical conductivity, nano-size tips, and other advantages. Due to these properties, it has been suggested that carbon nanotubes could be an ideal material for field emission applications.

In both convention field emission displays that use metal microtips as emitters and in field emission displays that use carbon nanotubes as emitters, a barrier array is used to separate and insulate the cathode and the gate electrodes. To achieve superior display quality, the barrier array should be made with high accuracy and uniformity throughout the entire barrier array, and the material of which the barrier array is made should not be porous, since otherwise air may become trapped in the pores. Furthermore, such applications as field emission displays demand that the barrier have a flat upper surface and highly accurate height. Thus the barrier array is a critical element in a field emission display.

The two main methods for making barrier arrays in the art are the screen printing method and the sandblasting method. In the screen printing method, a barrier array is formed by repeatedly screen printing and drying paste material on a substrate, and then baking the assembly. However, during the repeated printing and drying procedure, it is difficult to ensure that the barrier array has a flat upper surface and uniform height, and this leads to increases in production costs. In addition, it is also difficult to fabricate the barrier array to a high precision when using the screen printing method. Thus, screen printing is not suitable for mass production of high quality barrier arrays used in field emission displays.

In the sandblasting method, which is widely used, material for the barrier array is applied to a substrate at a predetermined thickness, and then dried. Then a protective film having the shape of the desired barrier array is formed on the assembly, or a sand blasting mask is attached to the assembly. Sand is injected at high pressure so that unwanted portions of the material are removed, thus forming the barrier array. Finally, the barrier array is baked. However, the whole manufacturing process takes a considerable time, and control of the sand injection must be highly accurate. The sandblasting method is not very reliable, and is also prone to contaminate the manufacturing environment with sand.

Other methods for making barrier arrays for flat panel displays comprise photolithography, molding, and casting. However, all these methods require mating of a substrate with suitable pastes, as well as drying and baking processes. This makes these methods unduly time-consuming. Furthermore, it is difficult to fabricate barrier arrays using these methods to a high precision.

As described above, these difficulties of barrier array manufacturing greatly limit mass production of field emission displays having high precision. Thus a field emission display with an improved barrier array which overcomes the above-mentioned problems is desired

SUMMARY OF THE INVENTION

In view of the above-described drawbacks, an object of the present invention is to provide a field emission display which has a high precision barrier array.

Another object of the present invention is to provide a field emission display having a barrier array which is suitable for mass production at low cost.

A further object of the present invention is to provide a field emission display having a barrier array which is made in an environmentally friendly manner.

In order to achieve the objects set out above, a field emission display having a barrier array in accordance with the present invention comprises a substrate; cathode electrodes formed on the substrate, the cathode electrodes together with the substrate defining a pixel pattern; a plurality of emitters formed on the cathode electrodes; a barrier array defining a plurality of openings therethrough according to the pixel pattern, the barrier array comprising a shadow mask with an insulative layer formed thereon; gate electrodes formed on the barrier array; and a phosphor screen spaced from the substrate. This field emission display employs the known technology for making a shadow mask in the field of CRTs. In addition, a thickness and a material of the shadow mask can be selected according to the particular requirements of the field emission display required. Furthermore, the thickness and the material of the insulative layer can be determined by the insulative performance required for the field emission display. Moreover, the barrier array may be formed in sufficient size that it can be subdivided for use in one or more field emission displays. In summary, the present invention provides a field emission display having a barrier array made to a high degree of precision which is low in production cost. The barrier arrays are also suitable for mass production in an environmentally friendly manner.

Other objects, advantages and novel features of the present invention will become more apparent from the following detailed description when taken in conjunction with the accompanying drawings, in which:

DETAILED DESCRIPTION OF PREFERRED EMBODIMENTS OF THE INVENTION

Figure 1:
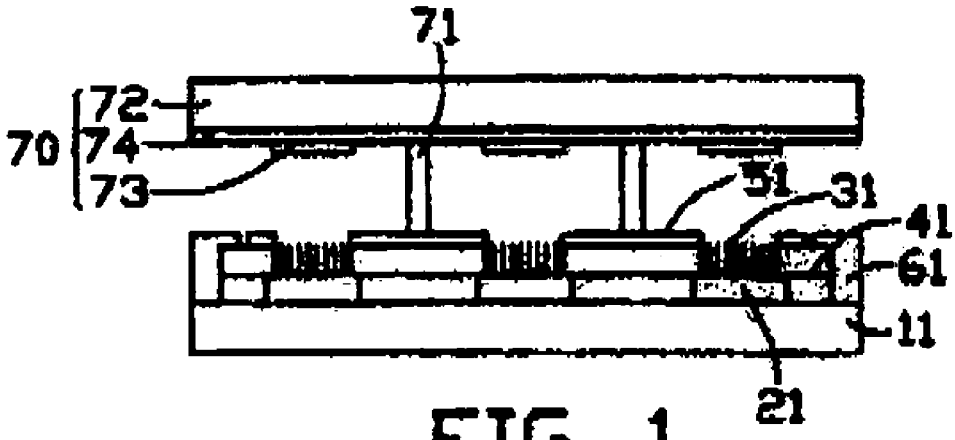
FIG. 1 is a schematic side view of a field emission display having an improved barrier array in accordance with a preferred embodiment of the present invention.

Referring to FIG. 1, a field emission display in accordance with a preferred embodiment of the present invention comprises a first substrate 11, cathode electrodes 21 formed on the first substrate 11, the cathode electrodes 21 together with the substrate 11 defining a pixel pattern; carbon nanotubes 31 formed on the cathode electrodes 21; a barrier array 41 defining a plurality of openings 42 (see FIG. 3) therethrough according to the pixel pattern; gate electrodes 51 formed on the barrier array 41; and a phosphor screen 70 spaced from the first substrate 11.

Figure 2:
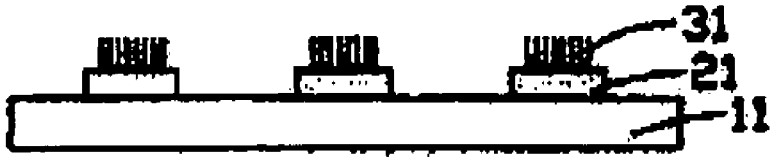
FIG. 2 is a schematic side view of a substrate of the field emission display of FIG. 1 with cathode electrodes and carbon nanotubes formed thereon.

Referring to FIG. 2, the substrate 11 can be glass, ceramic, silicon oxide, alumina or another suitable insulative material having a surface with a total thickness variation of less than 1 micrometer. The substrate 11 must endure the temperatures at which carbon nanotubes grow, generally being temperatures higher than 700° C. The cathode electrodes 21 are formed on the substrate 11 by electroplating or magnetron sputtering.

Also referring to FIG. 2, the carbon nanotubes 31 can be formed on the cathode electrodes 21 by directly growing them on the cathode electrodes 21, or by transplanting preformed carbon nanotubes onto the cathode electrodes 21. The preformed carbon nanotubes can be formed on a silicon substrate by chemical vapor deposition. Then, the preformed carbon nanotubes can be transplanted onto the cathode electrodes 21 using electrically conductive adhesive.

A preferred method for growing the carbon nanotubes 31 directly on the cathode electrodes 21 comprises the following steps: depositing a silicon layer (not shown) on the cathode electrodes 21 to a thickness of several tens of nanometers; depositing a catalyst layer (not shown) on the silicon layer to a thickness in the range from 1 nanometer to several tens of nanometers, the catalyst layer being iron, cobalt, nickel or any suitable combination alloy thereof; annealing the catalyst layer at 300~400° C. for almost 10 hours; heating the cathode electrodes 21 with the catalyst layer up to 650~700° C. in flowing protective gas; introducing a carbon source gas, such as acetylene; and thus forming carbon nanotubes 31 extending from the cathode electrodes 21.

Figure 3:
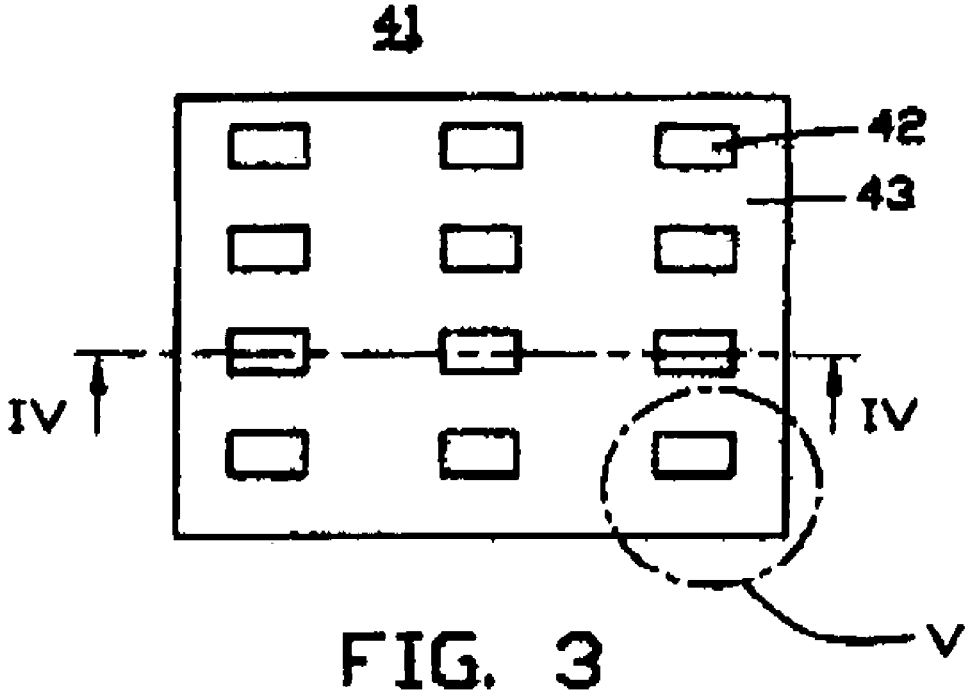
FIG. 3 is schematic top plan view of a barrier array of the field emission display of FIG. 1.
Figure 4:
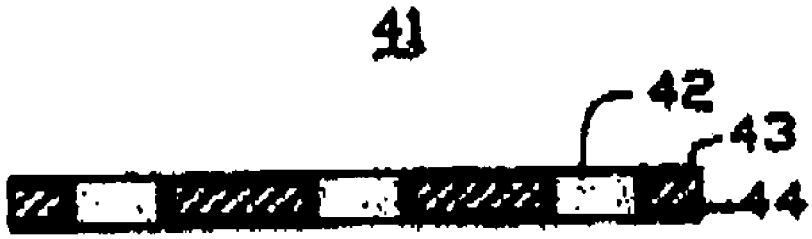
FIG. 4 is a cross-sectional view of the barrier array of FIG. 3, taken along line IV-IV thereof.
Figure 5:
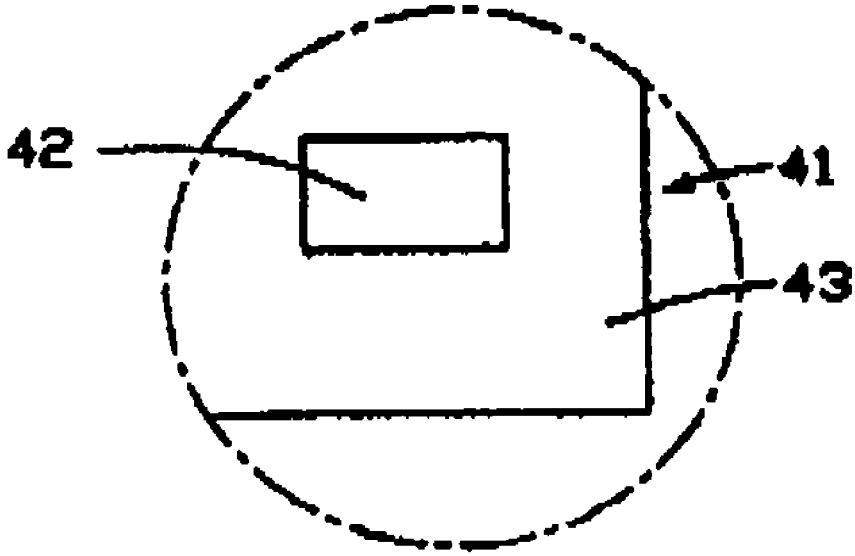
FIG. 5 is an enlarged view of a circle portion V of FIG. 3, said portion comprising a single barrier.

FIGS. 3-4 show the barrier array 41 used in the field emission display according to the preferred embodiment of the present invention, and FIG. 5 is an enlarged view of part of FIG. 3, said part comprising a single barrier. The barrier comprises a part of a shadow mask 44 defining an opening 42 therethrough and having an insulative layer 43 formed thereon. A method for making the barrier array 41 comprises the following steps: providing a metal plate; using the metal plate to form the shadow mask 44; and forming the insulative layer 43 on the shadow mask 44. The metal plate can be made from invar (an alloy of iron and nickel), low carbon steel, or another suitable metal alloy that has a coefficient of thermal expansion matching that of the substrate of the field emission display. A thickness of the insulative layer 43 is in the range from 10 to 500 micrometers, and preferably in the range from 75 to 200 micrometers.

A mask is provided prior to forming the shadow mask 44. The mask has a predetermined pattern corresponding to the pixel pattern of the field emission display. The shadow mask 44 is then formed by photolithographic etching using the mask. Thus, the shadow mask 44 also has the predetermined pattern. The pattern comprises a plurality of openings 42 evenly arranged in an array according to the pixel pattern of the field emission display (see FIG. 3). The insulative layer 43 can be formed by electrophoretic deposition, spray coating, or another suitable method. Preferably, the electrophoretic deposition method is employed. The insulative layer 43 can be alumina, magnesia or another insulative material selected according to a required insulative performance of the field emission display.

In the preferred method of making the barrier array 41, alumina is used as the insulative material, and electrophoretic deposition is used to form the insulative layer 43. In the electrophoretic deposition, the shadow mask 44 is used as an anode, and aluminum metal is used as a cathode. An electrolyte comprises aluminum ions. In the preferred method, the electrolyte comprises methyl alcohol (600 ml), magnesium sulfate (6 g), aluminum nitrate (30 ml), alumina (900 g), and deionized water (600 ml). The time needed for the electrophoretic deposition is determined by a required thickness of the insulative layer 43 of the field emission display, which in turn is determined according to a required insulative performance of the field emission display. In the preferred embodiment, the thickness of the alumina is 80 micrometers, and the time for electrophoretic deposition is 3 minutes.

The barrier array 41 is formed once an insulative layer 43 of alumina material has been deposited on the shadow mask 44 to a predetermined thickness. After insulative layer 43 has been deposited on the shadow mask 44, the barrier array 41 is preferably soaked in a solution for a predetermined time to clean surfaces of the barrier array 41. In the preferred method, the solution comprises ethyl cellulose (85 g), butyl alcohol (60 ml) and xylene (3400 ml, 3°), and the predetermined time is 1~5 minutes. Then, the barrier array 41 is cured.

Figure 6:
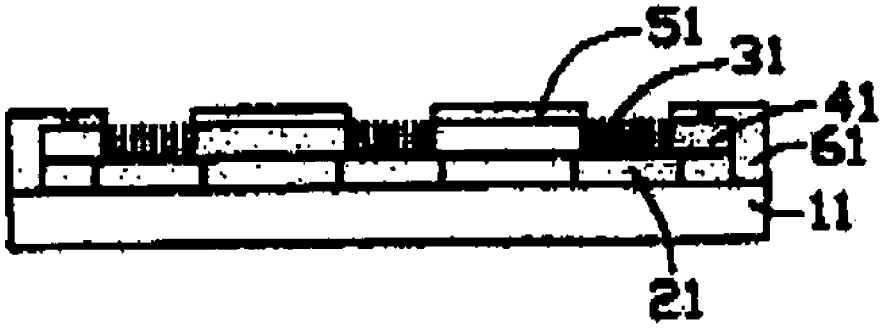
FIG. 6 is a schematic side view of the barrier array with gate electrodes formed thereon being fixed to the substrate of FIG. 1.

Referring to FIG. 6, the gate electrodes 51 are formed on the barrier array 41 by electron beam evaporation, thermal evaporation, or sputtering. The barrier array 41 with the gate electrodes 51 formed thereon is fixed to substrate 11 by a frame 61 having a fixing surface (not shown) using powdered glass having a low melting point to fuse the frame 61 to the substrate 11. The barrier array 41 is flattened by applying stress to the frame 61.

Also referring to FIG. 1, the phosphor screen 70 comprises a transparent anode electrode 74 formed on a second substrate 72 and phosphor coatings 73 formed on the anode electrode 74 according to the pixel pattern. Preferably, supporting members 71 are employed to both support the phosphor screen 70 and to clamp the barrier array 41 to the substrate 11 to assure that the barrier array 41 lies flat against the substrate 11.

It will be apparent to those having skill in the field of the present invention that the field emission display of the present invention is not only suitable employment with carbon nanotubes as emitters, but is also suitable employment with metal microtips as emitters.

Because making a shadow mask is a known technology in the field of CRTs, the above-described preferred embodiment according to the present invention is convenient to make. In addition, a thickness and a material of the shadow mask can be selected according to the particular requirements of the field emission display desired. Furthermore, the thickness and the material of the insulative layer 43 can be determined according to the insulative performance required for the field emission display. Moreover, the barrier array may be formed in sufficient size that it can be subdivided for use in one or more field emission displays. In summary, the present invention provides a field emission display having a barrier array made to a high degree of precision which is low in production cost. The barrier array is also suitable for mass production in an environmentally friendly manner.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. A field emission display comprising:

a substrate;

cathode electrodes formed on the substrate, the cathode electrodes together with the substrate defining a pixel pattern;

a plurality of emitters formed on the cathode electrodes;

a barrier array defining a plurality of openings according to the pixel pattern, the barrier array comprising a shadow mask, an insulative layer being formed on outside surfaces of the shadow mask and inside surfaces of the shadow mask surrounding the plurality of openings, the barrier array being fixed to the substrate;

gate electrodes formed on the barrier array; and a phosphor screen spaced from the substrate.

2. The field emission display as described in claim 1, wherein the substrate can be glass, ceramic, silicon oxide, alumina.

3. The field emission display as described in claim 1, wherein the shadow mask is made from a material selected from the group: invar, low carbon steel, and the material has a coefficient of thermal expansion matching that of the substrate.

4. The field emission display as described in claim 1, wherein the insulative layer comprises alumina or magnesia.

5. The field emission display as described in claim 4, wherein a thickness of the insulative layer is in the range from 10 to 500 micrometers.

6. The field emission display as described in claim 5, wherein the insulative layer is formed on the shadow mask by spray coating.

7. The field emission display as described in claim 5, wherein the insulative layer is formed on the shadow mask by electrophoretic deposition.

8. The field emission display as described in claim 1, wherein the field emission display further comprises a frame fixed to the substrate.

9. The field emission display as described in claim 8, wherein the barrier array is fixed to the substrate by the frame, the frame having a fixing surface and powdered glass having a low melting point being used to fuse the frame to the substrate.

10. The field emission display as described in claim 1, wherein the emitters employed by the field emission display comprise carbon nanotubes or metal microtips.

11. The field emission display as described in claim 1, wherein the field emission display further comprises supporting members for supporting the phosphor screen and clamping the barrier array to the substrate to assure that the barrier array lies flat against the substrate.

12. The field emission display as described in claim 1, wherein the phosphor display comprises a second substrate with an anode electrode formed thereon and phosphor coatings formed on the anode electrode according to the pixel pattern.

13. A field emission display comprising:

a substrate;

cathode electrodes formed on the substrate, the cathode electrodes together with the substrate defining a pixel pattern;

a plurality of emitters formed on the cathode electrodes;

a metal plate defining a plurality of openings therethrough according to the pixel pattern, an insulative layer being formed on outside surfaces of the metal plate and inside surfaces of the metal plate surrounding the plurality of openings, the metal plate with the insulative layer formed thereon being fixed to the substrate;

gate electrodes formed on the insulative layer; and a phosphor screen spaced from the substrate.

14. The field emission display as described in claim 13, wherein the metal plate is selected from the group: invar, low carbon steel, and the material has a coefficient of thermal expansion matching that of the substrate.

15. The field emission display as described in claim 13, wherein the insulative layer comprises alumina or magnesia.

16. The field emission display as described in claim 13, wherein the emitters employed by the field emission display comprise carbon nanotubes or metal microtips.

17. A method of making a field emission display, comprising steps of:

providing a substrate;

forming cathode electrodes on the substrate, the cathode electrodes together with the substrate defining a pixel pattern;

disposing a plurality of emitters on the cathode electrodes;

fixing a barrier array to the substrate, said barrier array defining a plurality of openings according to the pixel pattern, the barrier array comprising a metal plate, an insulative layer being formed on outside surfaces of the metal plate and inside surfaces of the metal plate surrounding the plurality of openings;

locating gate electrodes formed on the barrier array; and providing a phosphor screen spaced from the substrate.

* * * * *